US011265976B2

(12) United States Patent
Kuchler et al.

(10) Patent No.: US 11,265,976 B2
(45) Date of Patent: Mar. 1, 2022

(54) MICROWAVE COOKING DEVICE WITH A LAMBDA QUARTER-WAVE TRAP

(71) Applicant: BSH Hausgeräte GmbH, Munich (DE)

(72) Inventors: Markus Kuchler, Gstadt am Chiemsee (DE); Kerstin Rigorth, Mühldorf (DE); Sebastian Sterz, Großaitingen (DE); Matthias Vogt, Obersulm (DE)

(73) Assignee: BSH Hausgeräte GmbH, Munich (DE)

( * ) Notice: Subject to any disclaimer, the term of this patent is extended or adjusted under 35 U.S.C. 154(b) by 116 days.

(21) Appl. No.: 16/603,593

(22) PCT Filed: Jun. 8, 2018

(86) PCT No.: PCT/EP2018/065184
§ 371 (c)(1),
(2) Date: Oct. 8, 2019

(87) PCT Pub. No.: WO2019/001932
PCT Pub. Date: Jan. 3, 2019

(65) Prior Publication Data

US 2021/0092807 A1 Mar. 25, 2021

(30) Foreign Application Priority Data

Jun. 26, 2017 (DE) ..... 10 2017 210 730.8

(51) Int. Cl.
*H05B 6/76* (2006.01)

(52) U.S. Cl.
CPC ..... *H05B 6/763* (2013.01)

(58) Field of Classification Search
CPC ..... H05B 6/763; H05B 6/80; H05B 6/6414
See application file for complete search history.

(56) References Cited

U.S. PATENT DOCUMENTS 4,475,023 A * 10/1984 Iwabuchi ..... H05B 6/763 219/742
4,713,511 A 12/1987 Katoh
(Continued)

FOREIGN PATENT DOCUMENTS

CN 1192520 A 9/1998
DE 2522934 A1 12/1975
(Continued)

OTHER PUBLICATIONS

International Search Report PCT/EP2018/065184 dated Sep. 6, 2018.
National Search Report CN 201880042402.4 dated May 26, 2021.

*Primary Examiner* — Helena Kosanovic
*Assistant Examiner* — Lawrence H Samuels
(74) *Attorney, Agent, or Firm* — Michael E. Tschupp; Andre Pallapies; Brandon G. Braun

(57) ABSTRACT

A microwave cooking appliance includes a door which covers a loading opening of a cooking chamber when closed, and has a profiled trap structure to form with an electrically conductive door flange a lambda quarter-wave trap that frames the loading opening. The trap structure includes a metal choke profile with an open face opposite the door flange, inner and outer metal tongues protruding into the open face laterally on an inside and outside, respectively. The metal tongues are connected electrically to the choke profile and separated from one another by a microwave entry slot covered by a microwave-transparent cover. The choke profile is framed laterally on the outside by a parallel overlap region which protrudes from the door flange and has a cover surface facing the door flange at a distance and made of electrically conductive material and having a same shape as a door flange region it covers.

12 Claims, 9 Drawing Sheets

(56) References Cited

U.S. PATENT DOCUMENTS

| | | | | | |
|---|---|---|---|---|---|
| 4,742,201 | A * | 5/1988 | Nakano | H05B 6/763 | 219/742 |
| 4,868,359 | A | 9/1989 | Iwabuchi et al. | | |
| 5,075,525 | A * | 12/1991 | Jung | H05B 6/763 | 219/742 |
| 5,206,478 | A * | 4/1993 | Lee | H05B 6/763 | 174/382 |
| 5,705,797 | A * | 1/1998 | Seo | H05B 6/763 | 219/742 |
| 5,897,808 | A * | 4/1999 | Kim | H05B 6/763 | 219/741 |
| 7,301,132 | B2 * | 11/2007 | Kim | H05B 6/763 | 174/374 |
| 2004/0079751 | A1 | 4/2004 | Kim et al. | | |
| 2007/0039953 | A1 * | 2/2007 | Kim | H05B 6/763 | 219/742 |
| 2011/0290230 | A1 | 12/2011 | Sim et al. | | |
| 2012/0312808 | A1 * | 12/2012 | Tsujimoto | H05B 6/763 | 219/756 |
| 2016/0029442 | A1 | 1/2016 | Houbloss | | |
| 2017/0318630 | A1 | 11/2017 | Frey et al. | | |

FOREIGN PATENT DOCUMENTS

| | | | |
|---|---|---|---|
| DE | 3106786 | A1 | 9/1982 |
| DE | 8606301 | U1 | 5/1990 |
| DE | 10256624 | A1 | 7/2004 |
| DE | 102006042992 | A1 | 4/2008 |

* cited by examiner

MICROWAVE COOKING DEVICE WITH A LAMBDA QUARTER-WAVE TRAP

CROSS-REFERENCES TO RELATED APPLICATIONS

This application is the U.S. National Stage of International Application No. PCT/EP2018/065184, filed Jun. 8, 2018, which designated the United States and has been published as International Publication No. WO 2019/001932 A1 and which claims the priority of German Patent Application, Serial No. 10 2017 210 730.8, filed Jun. 26, 2017, pursuant to 35 U.S.C. 119(a)-(d).

BACKGROUND OF THE INVENTION

The invention relates to a microwave cooking appliance, having a door, which in the closed state covers a loading opening of a cooking chamber and which has a profiled trap structure, which together with an electrically conductive door flange forms a lambda quarter-wave trap that frames the loading opening in the closed state, the trap structure having a metal choke profile with an open face opposite the door flange, an inner metal tongue protruding into the open face laterally on the inside and an outer metal tongue protruding into the open face laterally on the outside, said metal tongues being connected electrically to the choke profile and being separated from one another by a microwave entry slot, and the microwave entry slot being covered by a microwave-transparent cover. The invention can be applied particularly advantageously to household microwave appliances, for example standalone microwave cooking appliances or ovens and/or steam cooking appliances with microwave function.

In microwave cooking appliances microwaves can be supplied to a cooking chamber, to heat food present in the cooking chamber. The cooking chamber is delimited by a cooking chamber wall or muffle, which is essentially impermeable to microwave radiation. The cooking chamber typically has a front loading opening, which can be closed by means of a door. A closed door covers the loading opening and an associated edge region thereof, which is referred to as a door flange. The door and a gap between the door and the door flange should not allow the passage of microwaves to the outside and are therefore sealed in respect of exiting microwave radiation, even if there is no electrical contact in the overlap region between door flange and door. To prevent microwaves exiting between door and door flange when the door is closed, what are known as $\lambda/4$ or lambda quarter-wave traps are known, a wavelength of the microwaves being designated by lambda.

GB 2196520 A, US 2004/0079751 A1 and DE 10 2014 224 053 A1 for example describe lambda quarter-wave traps. The lambda quarter-wave traps here are behind a cover, which protects them from dirt or mechanical damage. The cover can be made of microwave-transparent plastic. It is known from DE 102 56 624 B4, US 2011/0290230 A1, EP 2 775 794 A1 and DE 3536589 C2 that the lambda quarter-wave traps can be positioned behind a viewing window facing the cooking chamber.

BRIEF SUMMARY OF THE INVENTION

It is the object of the present invention at least partially to overcome the disadvantages of the prior art and in particular to provide a lambda quarter-wave trap or door choke for microwave appliances, the choking or shielding effect of which is particularly insensitive to changes, in particular increases, in the door gap. It should also allow a particularly high level of insensitivity to obliquely incident microwave radiation. It should also allow particularly compact dimensioning of the lambda quarter-wave trap.

Said object is achieved according to the features of the independent claims. Preferred embodiments will emerge from the dependent claims in particular.

The object is achieved by a microwave cooking appliance, having a door which in the closed state covers a loading opening of a cooking chamber that can be supplied with microwaves. The microwave cooking appliance is described with the door in the closed position in the following, unless an opened state is specifically indicated. The door has a profiled trap structure. When the door is in the closed state, the trap structure, together with an electrically conductive door flange, forms a lambda quarter-wave trap for microwaves that frames the loading opening. The trap structure has a metal profile (referred to in the following without restricting its general nature as the "choke profile") with an open face opposite the door flange. A metal tongue (referred to in the following without restricting its general nature as the "inner metal tongue") protrudes into the open face laterally on the inside. A laterally inside arrangement can also be referred to or considered as a radially inside arrangement when viewed from the front or as a cooking chamber side arrangement. A metal tongue (referred to in the following without restricting its general nature as the "outer metal tongue") also protrudes into the open face laterally on the outside. A laterally outside arrangement can also be referred to or considered as a radially outside arrangement when viewed from the front or as an arrangement facing away from the cooking chamber. The metal tongues are connected electrically to the choke profile and are arranged at a distance from one another in the open face. In other words they are separated from one another by a slot (referred to in the following without restricting its general nature as the "microwave entry slot"). The microwave entry slot is covered in particular by a microwave-transparent cover. The choke profile is framed laterally on the outside by a door region protruding from the choke profile in the direction of the door flange (referred to in the following without restricting its general nature as the "parallel overlap region"). The parallel overlap region has a surface (referred to in the following without restricting its general nature as the "cover surface") facing the door flange and made of electrically conductive material, which is shaped in the same manner as the region of the door flange it covers and arranged at a distance from the door flange.

This microwave cooking appliance has the advantage that the trap structure forms a lambda quarter-wave trap, the choking or shielding effect of which is particularly insensitive to changes, in particular increases, in the door gap. This in turn results in greater stability in respect of thermal movements inter alia and in respect of manufacturing tolerances, which has significant advantages for the production process. The trap structure also allows a particularly high level of insensitivity to obliquely incident microwave radiation. The smaller the displacement of the ideal active frequency when the angle of incidence of the microwave radiation exiting the cooking chamber changes, the more effectively the choke profile can ensure a low level of leaked radiation. It also allows particularly compact dimensioning of the lambda quarter-wave trap, which takes up less space than before inside the door. It is thus possible to increase the height and width of the cooking chamber—and therefore the total volume that can be used for treating food—without any loss of microwave shielding capacity. The optional microwave-transparent cover prevents soiling of or damage to the profile, in particular also soiling of the hollow space in the choke profile.

The microwave cooking appliance can be a household appliance, in particular a kitchen appliance. The microwave cooking appliance can be a standalone microwave cooking appliance or a different cooking appliance—e.g. an oven and/or a steam cooking appliance—with microwave function.

The door is sealed in respect of the passage of microwave radiation and can also be referred to as a microwave door.

That the door has a profiled trap structure can mean in particular that the trap structure has an at least essentially identical cross-sectional shape along its longitudinal extension ("profile direction"). The profile direction runs around the loading opening when viewed from the front.

The metal tongues are positioned in particular parallel to the open face.

In one development the choke profile is a choke profile that is C-shaped in cross section. This is particularly easy to produce and allows an effective choking or shielding effect.

That the metal tongues are connected electrically to the choke profile can mean that the metal tongues are produced separately and then connected to the choke profile, for example by soldering. In an alternative development the metal tongues are integrated regions of the choke profile, in particular have been produced as a single piece with the choke profile. The metal tongues, the choke profile and/or the overlap region can be made of aluminum, copper and/or steel for example. Generally any other suitable material with good electrical conductivity can be used instead of metal.

In one development the microwave entry slot has an at least essentially identical width.

In one development the metal tongues are set back in relation to the cover surface in the direction of the door interior when viewed in cross section. In particular the parallel overlap region can be positioned directly against the outer metal tongue or the choke profile, in particular in a stepped manner.

The parallel overlap region and the choke profile can be produced as a single piece or alternatively can be produced separately and then be connected to one another at a later stage.

That the cover surface is shaped in the same manner as the region of the door flange it covers means that there is an at least essentially identical distance between the two surfaces and therefore a particularly uniform shielding effect. The cover surface and the region of the door flange covered by it can in particular be configured as flat or planar and be arranged parallel to one another, allowing a particularly stable choking effect.

In one embodiment at least one of the metal tongues runs into a hollow space formed by the choke profile. This has the advantage that the paths of the microwave radiation are extended, allowing the volume of the hollow space to be reduced. It is therefore possible to increase the height and/or width of the cooking chamber—and therefore the total volume that can be used for treating food—without any loss of microwave shielding capacity.

That at least one of the metal tongues runs into the hollow space can mean in particular that said metal tongue is bent into the hollow space or has one or more bends in cross section. At least one of the metal tongues therefore runs behind the open face of the choke profile.

Generally only the outer metal tongue, only the inner metal tongue or both metal tongues can run into the hollow space or be correspondingly bent.

In a further embodiment at least one of the metal tongues is equipped or toothed with a row of teeth in the profile direction, the teeth being separated from one another in the profile direction, in particular by interruptions such as slots (referred to in the following without restricting their general nature as "separating slots").

This makes use of the fact that microwave radiation present in the cooking chamber of the microwave cooking appliance strikes the lambda quarter-wave trap with different angles of incidence. It is very complex to predict the resulting angle of incidence accurately, as once it has been generated in a magnetron for example the microwave radiation can be reflected multiple times off the walls of the cooking appliance, before it strikes the lambda quarter-wave trap. With an obliquely incident microwave the effectively active trap length of an untoothed trap extends by a factor $1/\cos(\theta)$, where $\theta$ describes an angle between a surface normal of a door plane and a spread or propagation direction of the incident microwaves. The active frequency therefore also varies with the effective trap length, so that the lambda quarter-wave trap without teeth no longer operates optimally at arbitrary angles of incidence. This effect is particularly marked in the case of microwave cooking appliances with large muffle or cooking chamber dimensions, as different angles of incidence can occur in a very broad spectrum here. If the lambda quarter-wave trap has no divisions or teeth, surface currents can flow unimpeded in the wave propagation direction. Interruptions between the teeth prevent this however and deflect the currents in the direction of the interruptions, so that the associated microwaves have a much smaller angle of incidence. This angle of incidence can be so small that the situation almost corresponds to a microwave entering in the normal direction. This embodiment therefore allows a particularly high level of insensitivity to obliquely incident microwave radiation.

Generally only the outer metal tongue, only the inner metal tongue or both metal tongues can be toothed.

In one development at least one of the metal tongues is slotted by means of a row of laterally oriented separating slots.

A metal comb arrangement, the teeth of which are approx. 4 mm wide and the slots of which are approx. 2 mm wide, has proven particularly effective.

In a further embodiment the teeth are bent in the direction of the hollow space on at least one face adjoining a separating slot. This embodiment allows an even more marked improvement in the effect of the choke profile or the lambda quarter-wave trap in respect of obliquely incident microwaves.

In yet another embodiment the teeth are bent in the direction of the hollow space on a face adjoining the microwave entry slot. This embodiment also allows a much more marked improvement in the effect of the choke profile or the lambda quarter-wave trap in respect of obliquely incident microwaves.

In one development, which is advantageous for particularly simple structural implementation of the bend in the toothing or teeth, the interruptions or separating slots to be introduced between the teeth are formed by not cutting and freeing the interruptions completely but by bending the material to be freed along the long and/or short edge in the direction of the hollow space, allowing it to act as a trap element.

Generally the lengths of and/or distances between the interruptions etc. can be changed in an alternating manner.

In a further embodiment at least some of the separating slots—in particular all the separating slots—are straight slots and at least some of the teeth—in particular all the teeth—of at least one of the metal tongues have a rectangular basic shape. This embodiment is particularly simple to produce.

In another embodiment at least some of the teeth have a ring shape. This further improves the effect of the choke profile or the lambda quarter-wave trap in respect of obliquely incident microwaves. The ring shape can be a continuously curved shape such as a circular ring shape, an oval shape, an elliptical shape, etc., or a polygonal shape such as a rectangular shape, etc. An embodiment of the teeth with an at least approximately elliptical basic shape ("elliptical toothing") is particularly advantageous.

The ring-shaped teeth can be closed per se.

In another embodiment at least some of the ring-shaped teeth—in particular all the ring-shaped teeth—are interrupted. The associated gaps prevent wave propagation along the ring shape, further improving the choking effect. The gaps can be arranged symmetrically at the center. However the gaps can alternatively also be located in different segments or angle directions of the ring-shaped toothing. These positions can also alternate in some instances.

The ring-shaped teeth can be connected to the choke profile and/or to the overlap region by way of a separate web for each tooth. In other developments the ring-shaped teeth can be positioned on a common, continuous web. However they can also be connected without a web or by way of a direct connection to the choke profile and/or to the overlap region of the doors.

In a further embodiment the microwave-transparent cover is a self-supporting cover. Such a cover is particularly stable and also prevents the formation of ripples in the cover in a region of contact with the choke profile.

In a further embodiment the microwave-transparent cover is fastened to the trap structure by means of a permanently elastic, temperature-resistant and grease-resistant sealing compound. The sealing compound particularly reliably prevents any ingress of steam or dirt into the hollow space of the choke profile through a gap between the cover and the choke profile. In one development the sealing compound is or contains temperature-resistant silicone.

In a further development the sealing compound is arranged in a region formed by the protruding parallel overlap region, the outer metal tongue and an edge of the microwave-transparent cover.

In one development the microwave-transparent cover has a plate made of glass, in particular hardened glass. Glass is particularly resistant to thermal and chemical influences and also—in particular in the form of hardened glass—to mechanical stress.

In one embodiment the cover surface of the parallel overlap region protrudes over the microwave-transparent cover. This protects the microwave-transparent cover particularly reliably from direct mechanical contact with the door flange. It also results in a particularly reliable and tolerant shielding effect. Alternatively the cover surface of the parallel overlap region and the microwave-transparent cover are arranged flush with one another on the flange side.

BRIEF DESCRIPTION OF THE DRAWINGS

The properties, features and advantages of the present invention described above and the manner in which they are achieved will become clearer and more readily understandable in conjunction with the schematic description of an exemplary embodiment that follows, described in more detail in conjunction with the drawings.

DETAILED DESCRIPTION OF EXEMPLARY EMBODIMENTS OF THE PRESENT INVENTION

Figure 1:
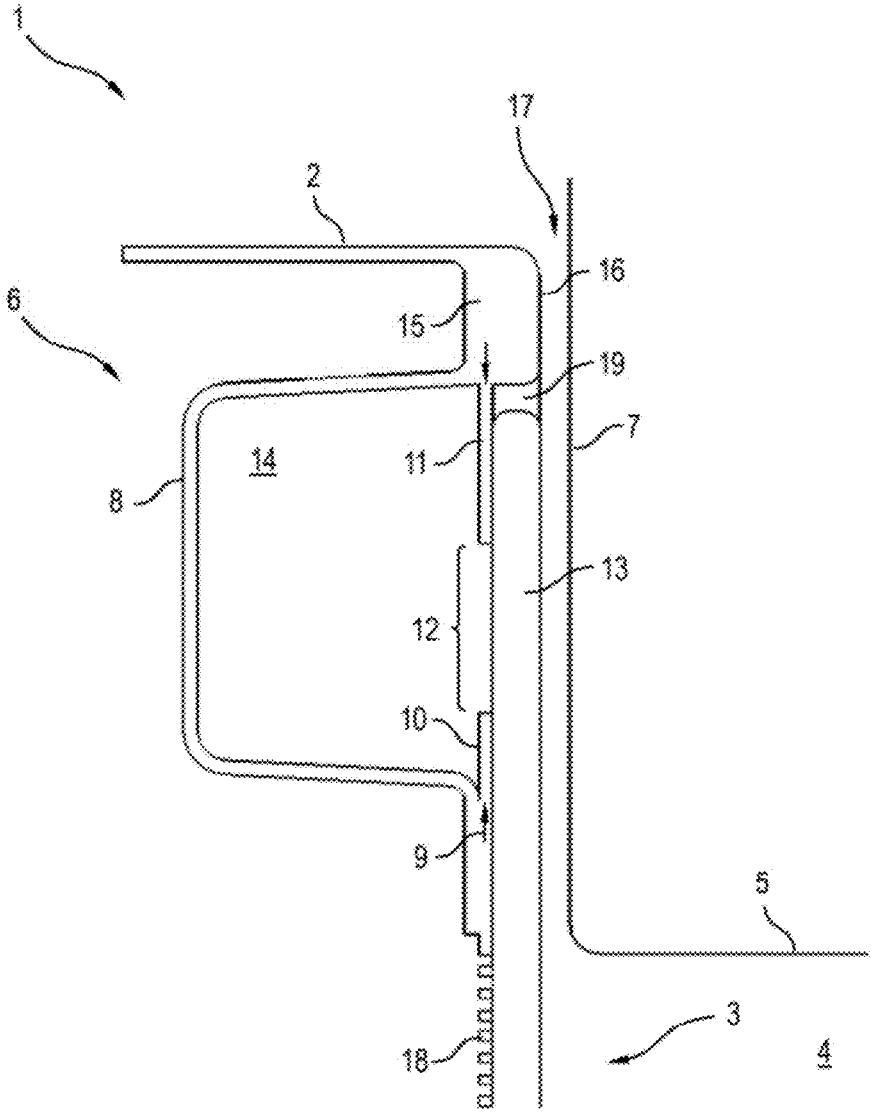
FIG. 1 to FIG. 3 show a sectional side view of a detail of a respective microwave cooking appliance according to a first to third exemplary embodiment, each with a different embodiment of the trap structure.

FIG. 1 shows a sectional side view of a detail of a microwave cooking appliance 1 according to a first exemplary embodiment with a door 2, which in the illustrated closed state covers a loading opening 3 of a cooking chamber 4. The cooking chamber 4 is delimited by a cooking chamber wall or muffle 5.

The door has a profiled trap structure 6, shown here on an upper edge of the door 2. When the door 2 is in the closed state, the trap structure 6 together with an electrically conductive door flange 7 forms a lambda quarter-wave trap that frames the loading opening 3.

The trap structure 6 has a metal choke profile 8 that is C-shaped in cross section and has an open face 9 opposite the door flange 7. An inner metal tongue 10 protrudes into the open face 9 laterally on the inside and an outer metal tongue 11 protrudes into the open face 9 laterally on the outside. The metal tongues 10 and 11 here are embodied here as a single piece with the choke profile 8 and separated from one another by a microwave entry slot 12. In a first variant the metal tongues 10 and/or 11 can be configured continuously or without interruption or in a strip in a profile direction perpendicular to the plane of the page. In a second variant the metal tongues 10 and/or 11 can be configured in the manner of a comb or teeth in the profile direction.

The microwave entry slot 12 is covered by a microwave-transparent cover in the form of a glass plate 13 made of hardened glass shown by way of example. This prevents any ingress of steam and dirt into a hollow space 14 formed by the choke profile 8.

The choke profile 8 is framed laterally on the outside by a parallel overlap region 15 protruding in the direction of the door flange 7, produced here in one variant as a single piece with the choke profile 8. The parallel overlap region 15 has a cover surface 16 facing the door flange 7 and made of electrically conductive material, which is shaped in the same manner as the region of the door flange it covers (specifically vertically flat here) and arranged at a distance from the door flange 7. The door flange 7 and cover surface 16 therefore form a door gap 17.

The glass plate 13 here is configured flush with the cover surface 16. The glass plate 13 has a viewing grid 18 that does not allow the passage of microwaves in its region opposite the loading opening 3 and can be formed for example in the manner of a printed metal grid. The glass plate 13 is fastened to the trap structure 6 by means of a permanently elastic, temperature-resistant and grease-resistant bonding agent (adhesive) or sealing compound 19. To this end the sealing compound 19 is introduced here into a lateral space between an edge of the glass plate 13 and the parallel overlap region 15.

Figure 2:
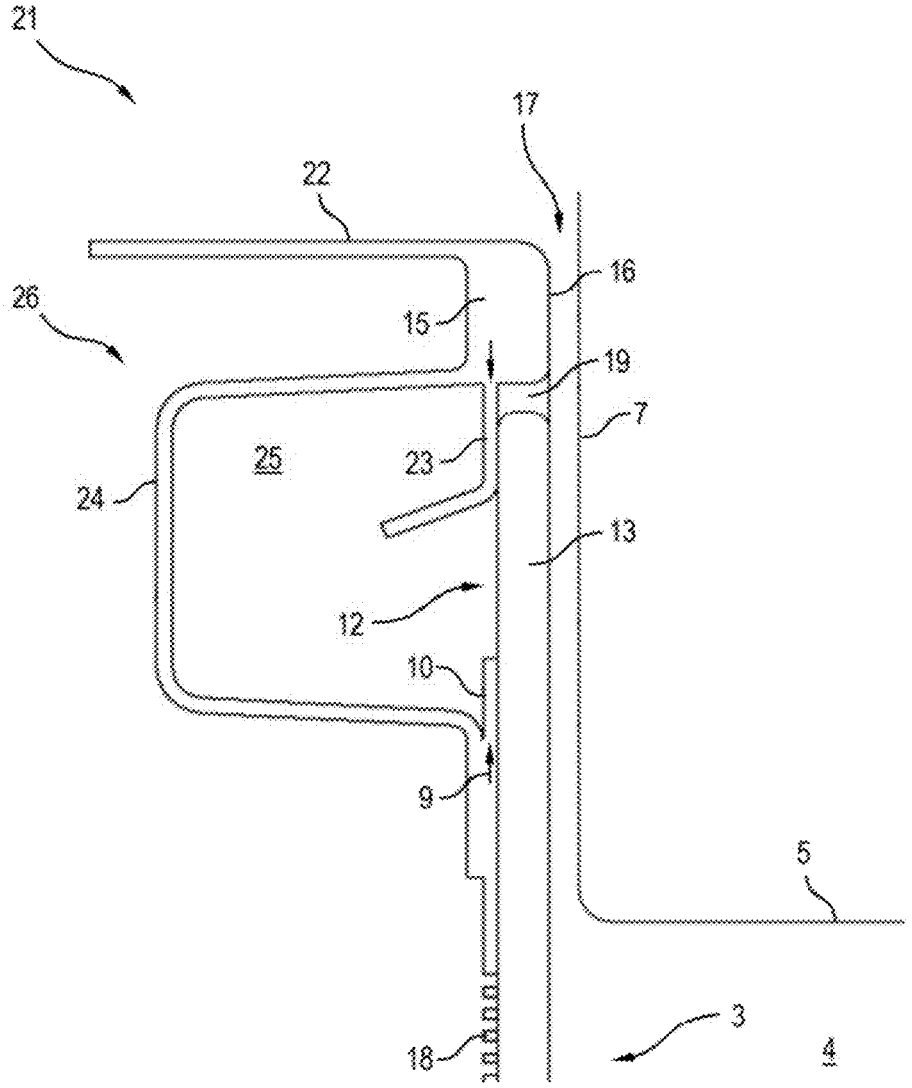

FIG. 2 shows a sectional side view of a detail of a microwave cooking appliance 21 according to a second exemplary embodiment with a door 22. The door 22 is configured in a similar manner to the door 2, but with the outer metal tongue 23 of a trap structure 26 being partially bent into a hollow space 25 formed by a choke profile 24 in cross section. The metal tongue 23 is therefore kinked or bent in cross section. This allows the choke profile 24 and therefore the hollow space 25 to be smaller but still maintain the same shielding effect, in this instance having a smaller height than the hollow space 14.

In a first variant the metal tongues 10 and/or 23 can be configured continuously or without interruption in the profile direction perpendicular to the plane of the page. In a second variant the metal tongues 10 and/or 23 can be configured in the manner of a comb or teeth in the profile direction.

Figure 3:
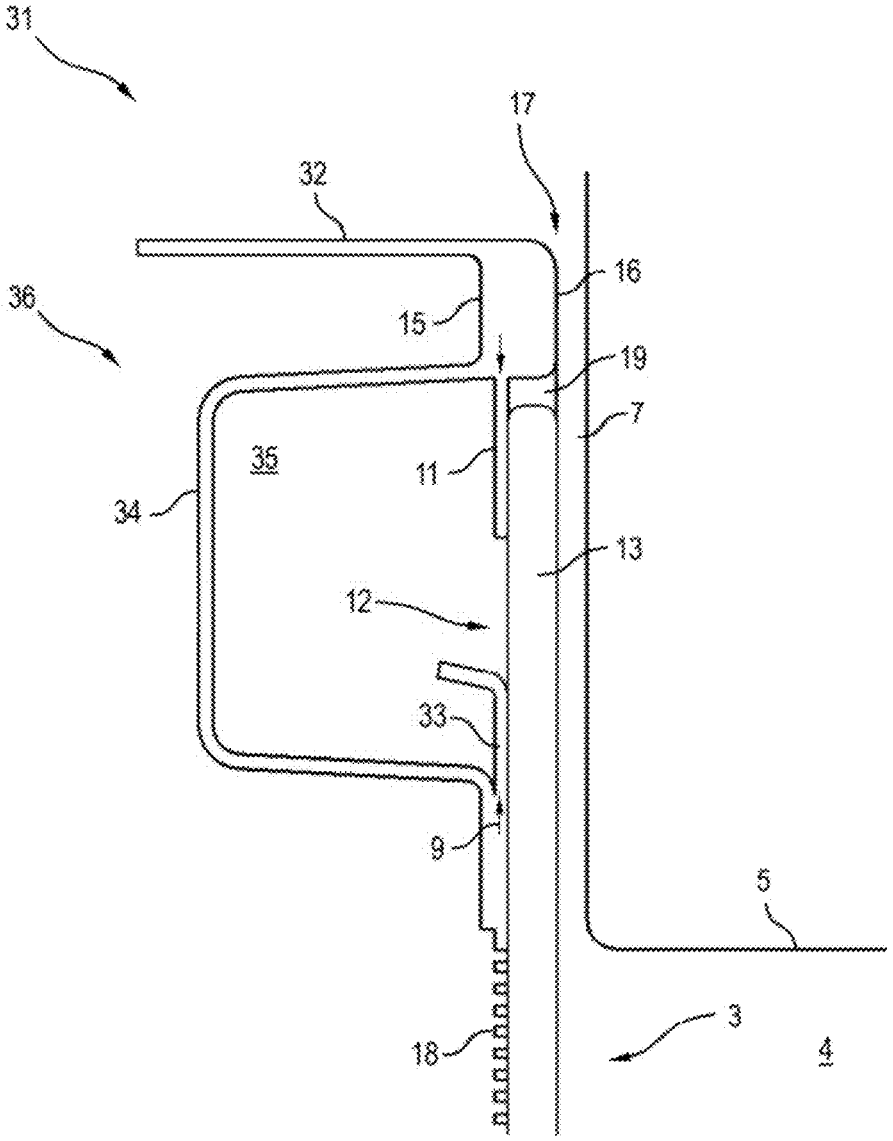

FIG. 3 shows a sectional side view of a detail of a microwave cooking appliance 31 according to a third exemplary embodiment with a door 32. The door 32 is configured in a similar manner to the door 2, but with the inner metal tongue 33 of a trap structure 36 now being partially bent into a hollow space 35 formed by a choke profile 34 in cross section.

In a further variant (not shown) both metal tongues can be bent into the hollow space.

Figure 4:
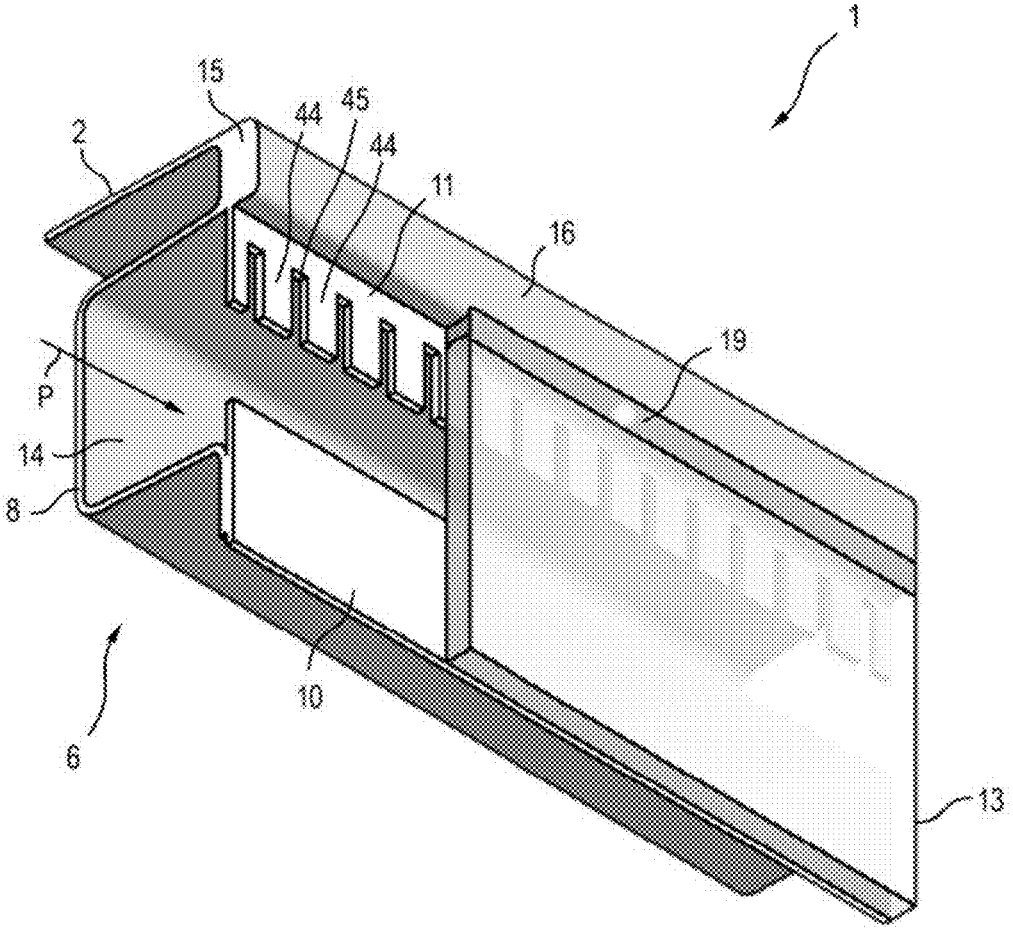
FIG. 4 to FIG. 5 show an oblique view from below of a detail of a respective microwave cooking appliance in particular according to the first or second exemplary embodiment with a comb-type trap structure.

FIG. 4 shows an oblique view from below of a detail of the microwave cooking appliance 1 according to its second variant with a glass plate 13 shown partially masked. The outer metal tongue 11 of the trap structure 6 here is toothed or provided with a row of teeth 44 in a profile direction P, said teeth 44 being separated from one another by straight separating slots 45. The teeth 44 each have a rectangular shape with a width of 4 mm in the profile direction P, while the separating slots 45 have a width of 2 mm.

Figure 5:
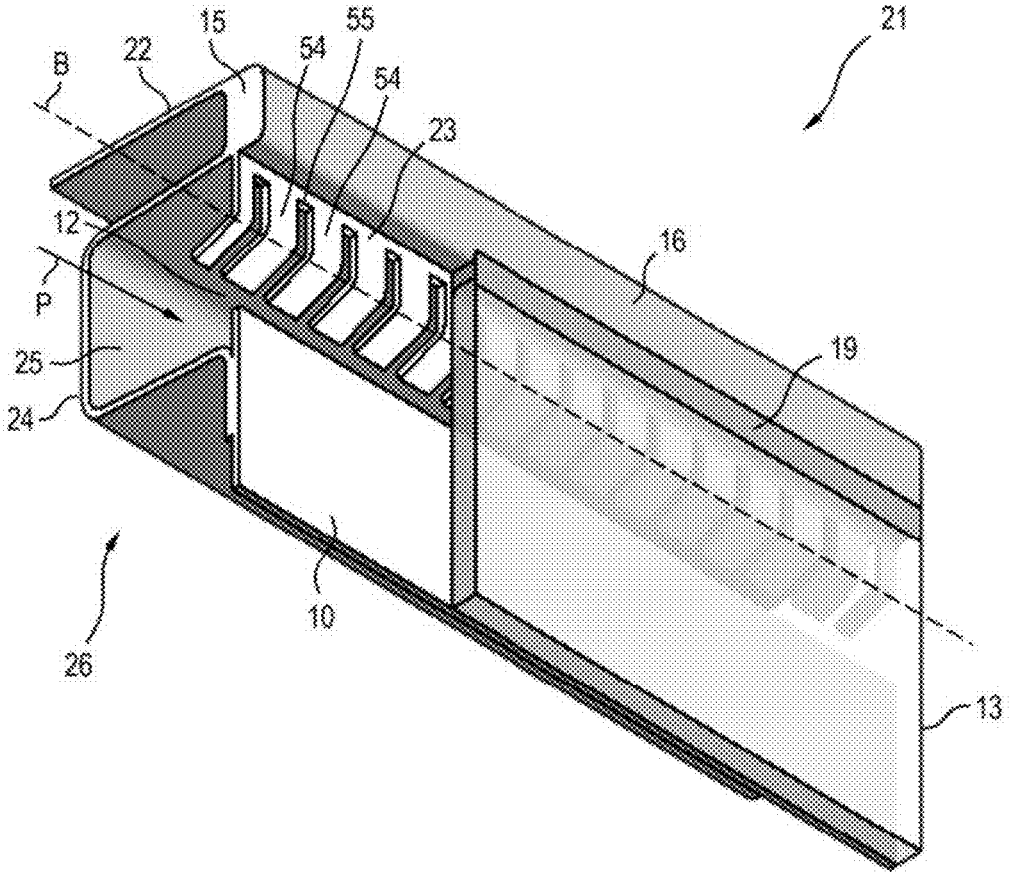

FIG. 5 shows a view like the one in FIG. 4 of a microwave cooking appliance 21 according to its second variant. The door 22 has an outer metal tongue 23 with teeth 54, which are separated from one another by separating slots 55. Some of the teeth 54 are bent in the direction of the hollow space 25 of the choke profile 24, about a bending line B extending in the profile direction P. In other words the teeth 54 are bent in the direction of the hollow space 25 on or along a face adjoining the microwave entry slot 12.

Figure 6:
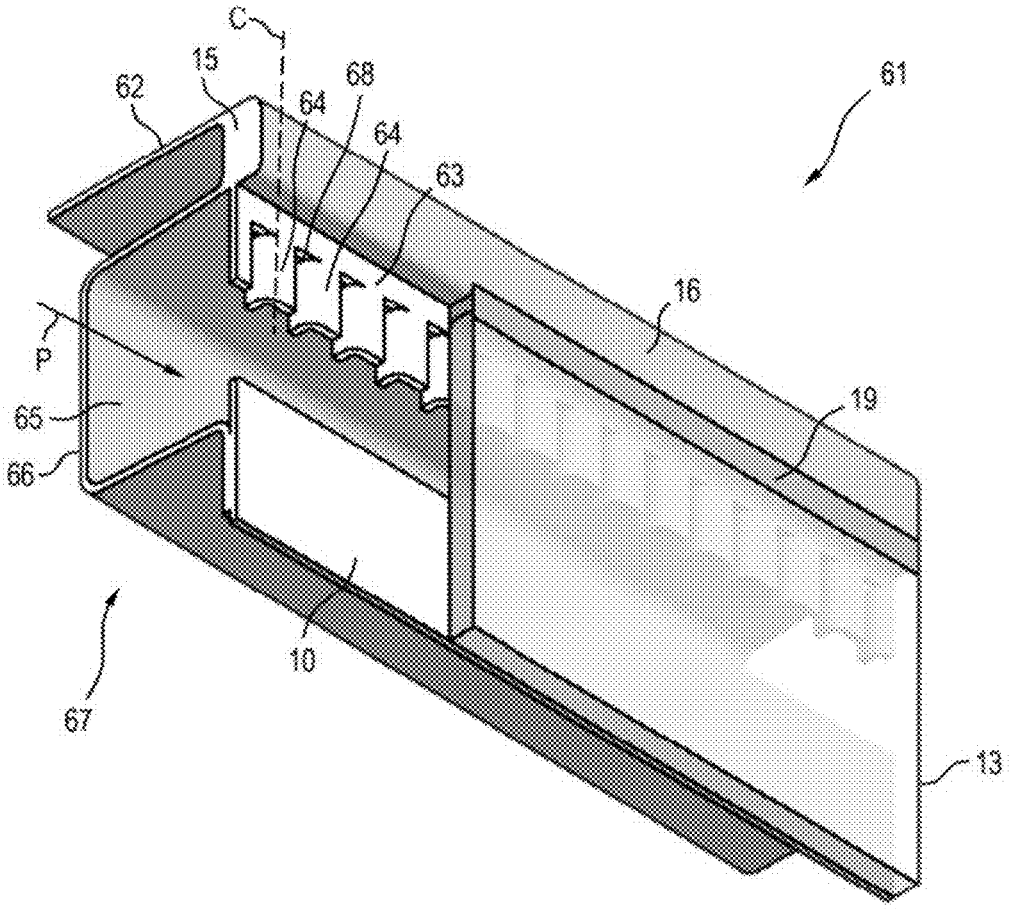
FIG. 6 to FIG. 7 show an oblique view from below of a detail of a respective microwave cooking appliance according to a fourth or fifth exemplary embodiment, each with a different embodiment of the trap structure.

FIG. 6 shows a view like the one in FIG. 4 of a microwave cooking appliance 61 according to a fourth exemplary embodiment. A door 62 is configured in a similar manner to the door 43, but the outer metal tongue 63 of a trap structure 67 now has teeth 64, some of which are bent in the direction of a hollow space 65 of a choke profile 66, about a bending line C extending perpendicular to the profile direction P. In other words the teeth 64 are bent in the direction of the hollow space 65 on at least one face adjoining a separating slot 68.

Figure 7:
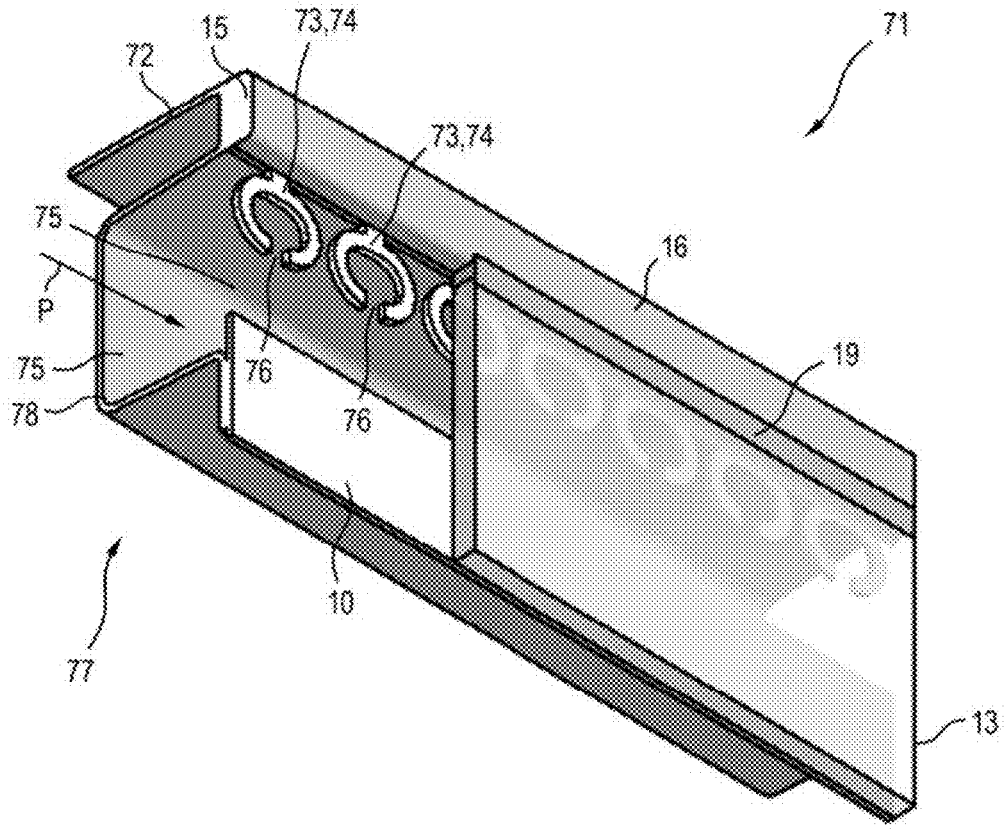

FIG. 7 shows a view like the one in FIG. 4 of a microwave cooking appliance 71 according to a fifth exemplary embodiment. A door 72 is configured in a similar manner to the door 42 but the outer metal tongue 73 now has teeth 74, which have an elliptical ring shape. The teeth 74 here all have a respective interruption 76 at their end facing the microwave entry slot 75.

However in other variants the interruptions can be present at a different point on the teeth, in some instances a different point in the profile direction. The ring-shaped teeth can also be without interruption in one variant.

Apart from the connection between the elliptical teeth 74 and the remainder of the trap structure 77 by way of respective webs as shown in FIG. 7, the teeth 74 for example can also be connected (Fig.) by way of a common continuous web or without a web with a direct connection to the trap structure 77, in particular to the choke profile 78 or the parallel overlap region 15.

The trap structure 77 with elliptical teeth 74, generally ring-shaped toothing, compensates for the effect of an obliquely incident electromagnetic wave much more effectively than the trap structures 6, 26, 36, 46, 56 and 67 that do not have a ring shape.

Figure 8:
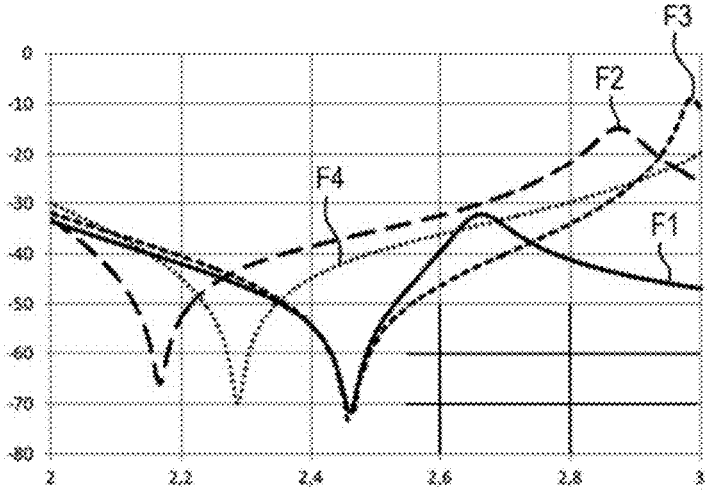
FIG. 8 to FIG. 10 show diagrams showing the shielding effect of a microwave cooking appliance with an inventive lambda quarter-wave trap compared with the prior art DE 102 56 624 B4.

FIG. 8 shows a graph of an attenuation in dB on the y-axis against a frequency in GHz on the x-axis for a microwave cooking appliance with characteristic attenuation curves F1 and F2 for the prior art DE 102 56 624 B4 and with characteristic attenuation curves F3 and F4 for a lambda quarter-wave trap according to the present invention, e.g. according to the exemplary embodiment in FIG. 4.

The attenuation curves F1 and F3 show the instance of an "ideal" door gap of 1 mm, in other words a door gap, with which an active frequency of the microwave trap or trap structure has been made to correspond to a working frequency of the microwave cooking appliance. However in practical applications the door gap will have different dimensions, its widening representing the critical instance. The causes are numerous and can be due to manufacturing tolerances or thermal movement of the appliance during heating operations for example. In actual use such a change in the door gap and different angles of incidence θ of the microwave radiation above all contribute to an unwanted change in shielding properties. A lambda quarter-wave trap shields leaked microwave radiation particularly reliably if it is particularly insensitive to changes, in particular increases, in the door gap due to its structure. Increased stability in respect of change is demonstrated primarily by a small change in the attenuation characteristic—in particular by a small displacement of the frequency position of maximum attenuation. The attenuation curves F2 and F4 show the instance of a door gap that is 1 mm wider (in other words a total of 2 mm wide).

The attenuation properties are practically identical for the ideal gap of 1 mm, as shown in the attenuation curves F1 and F3. In particular the positions of maximum attenuation are located at the same microwave frequency of approx. 2.455 GHz.

When the door gap is opened an additional 1 mm, the attenuation curves F2 and F4 in contrast show significant differences. The attenuation curve F4 for the lambda quarter-wave trap according to the present invention advantageously shows a much smaller displacement of the frequency position for maximum attenuation than the attenuation curve F2 according to the prior art.

Figure 9:
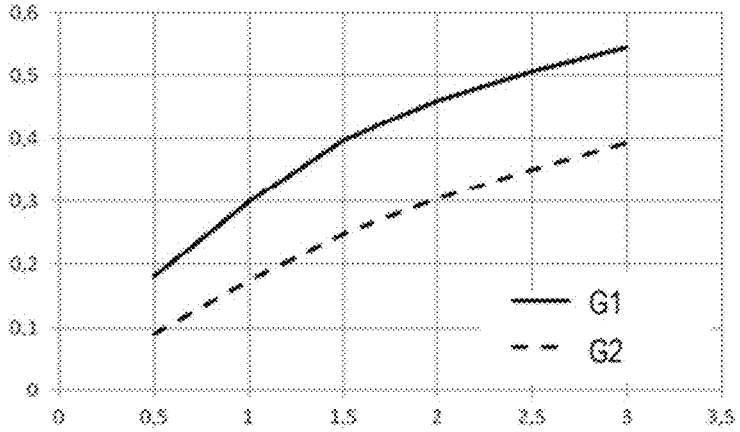

FIG. 9 shows a graph of a frequency displacement for the position of maximum attenuation in GHz on the y-axis against an increase in the door gap in mm on the x-axis for the prior art DE 102 56 624 B4 (curve G1) and for the lambda quarter-wave trap from FIG. 8 (curve G2).

In the prior art the ideal active frequency is displaced much further when the door gap increases than with the lambda quarter-wave trap according to the present invention. The fact that the lambda quarter-wave trap according to the present invention responds much less to changes in the door gap means that the door can be opened more before the leaked radiation reaches an unreliably high level. This means there is greater stability in respect inter alia of thermal movement and manufacturing tolerances, which has clear advantages for the production process among other things.

Figure 10:
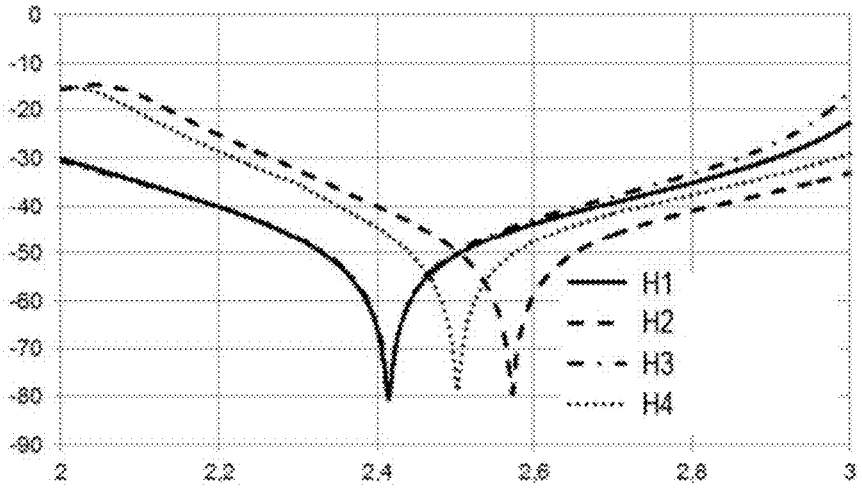

FIG. 10 shows a graph of an attenuation in dB on the y-axis against a frequency in GHz on the x-axis with characteristic attenuation curves H1 and H2 for the prior art DE 102 56 624 B4 and with characteristic attenuation curves H3 and H4 for a lambda quarter-wave trap with a trap structure 77 according to FIG. 7. While the attenuation curves H1 and H3 describe the attenuation with a small angle of incidence $\theta=7°$, the attenuation curves H2 and H4 describe the attenuation with a large angle of incidence $\theta=40°$. The smaller the displacement of the ideal active frequency when the angle of incidence $\theta$ of the microwave radiation from the cooking 4 chamber changes, the more reliably the lambda quarter-wave trap or the choke profile can ensure a low level of leaked radiation.

The trap structure 77 from FIG. 7 with elliptical or generally ring-shaped toothing compensates for the effect of an obliquely incident electromagnetic microwave much more effectively than the prior art. The lower level of sensitivity to changes in the angle of incidence $\theta$ means that this embodiment demonstrates a particularly reliable attenuation function as a microwave trap.

The present invention is of course not restricted to the exemplary embodiment shown.

Features of the various exemplary embodiments can therefore be combined in any manner. For example elliptical teeth can also be bent into a hollow space and/or different types of teeth can be present on a metal tongue.

Generally "one", etc. can refer to a single one or a multiple, in particular in the sense of "at least one" or "one or more", etc., unless this is specifically excluded, for example by the expression "just one".

A number can also refer to just the cited number as well as to a standard tolerance range, unless this is specifically excluded.

LIST OF REFERENCE CHARACTERS

1 Microwave cooking appliance
2 Door
3 Loading opening
4 Cooking chamber
5 Muffle
6 Trap structure
7 Door flange
8 Choke profile
9 Open face of choke profile
10 Inner metal tongue
11 Outer metal tongue
12 Microwave entry slot
13 Glass plate
14 Hollow space
15 Parallel overlap region
16 Cover surface
17 Door gap
18 Viewing grid
19 Sealing compound (adhesive)
21 Microwave cooking appliance
22 Door
23 Outer metal tongue
24 Choke profile
25 Hollow space
26 Trap structure
31 Microwave cooking appliance
32 Door
33 Inner metal tongue
34 Choke profile
35 Hollow space
36 Trap structure
44 Tooth
45 Separating slot
54 Tooth
55 Separating slot
61 Microwave cooking appliance
62 Door
63 Outer metal tongue
64 Tooth
65 Hollow space
66 Choke profile
67 Trap structure
68 Separating slot
71 Microwave cooking appliance
72 Door
73 Outer metal tongue
74 Tooth
75 Microwave entry slot
76 Interruption
77 Trap structure
78 Choke profile
B Bending line
C Bending line
F1-F4 Attenuation curves
G1-G2 Curves for a position of maximum attenuation
H1-H4 Attenuation curves
P Profile direction

The invention claimed is:

1. A microwave cooking appliance, comprising:

a door configured to cover a loading opening of a cooking chamber in a closed state, the door having a profiled trap structure configured to form in the closed state together with an electrically conductive door flange a quarter-wave trap that frames the loading opening;

the profiled trap structure including a metal choke profile with an open face opposite the door flange, an inner metal tongue protruding into the open face laterally from an inner side of the choke profile, and an outer metal tongue protruding into the open face laterally from an outer side of the choke profile, with the inner and outer metal tongues connected electrically to the choke profile and separated from one another by a microwave entry slot;

the choke profile being framed laterally on the outside by a parallel overlap region which protrudes continuously in a stepped manner from the outer metal tongue in the direction of the door flange;

the parallel overlap region having a cover surface which faces the door flange at a gap distance when the door is in the closed state, is made of electrically conductive material, and has a profile corresponding to the door flange; and a microwave-transparent cover in direct contact with the inner metal tongue and the outer metal tongue and covering the microwave entry slot.

2. The microwave cooking appliance of claim 1, wherein at least one of the inner and outer metal tongues is configured to extend into a hollow space formed by the choke profile.

3. The microwave cooking appliance of claim 1, wherein at least one of the inner and outer metal tongues is toothed with a row of teeth in a profile direction, with the teeth being separated from one another by separating slots.

4. The microwave cooking appliance of claim 3, wherein the teeth are bent in a direction of a hollow space formed by the choke profile on at least one face adjoining a corresponding one of the separating slots.

5. The microwave cooking appliance of claim 3, wherein the teeth are bent in a direction of a hollow space on a face adjoining the microwave entry slot.

6. The microwave cooking appliance of claim 3, wherein at least some of the separating slots are straight and at least some of the teeth have a rectangular basic shape.

7. The microwave cooking appliance of claim 3, wherein at least some of the teeth have a ring shape.

8. The microwave cooking appliance of claim 7, wherein at least some of the ring-shaped teeth are interrupted.

9. The microwave cooking appliance of claim 1, wherein the microwave-transparent cover is a self-supporting cover, and further comprising a permanently elastic, temperature-resistant and grease-resistant sealing compound to fasten the microwave-transparent cover to the trap structure.

10. The microwave cooking appliance of claim 1, wherein the cover surface of the parallel overlap region protrudes over the microwave-transparent cover.

11. The microwave cooking appliance of claim 1, wherein the cover surface of the parallel overlap region is arranged flush with the microwave-transparent cover.

12. The microwave cooking appliance of claim 1, wherein the microwave-transparent cover covers both the microwave entry slot and a viewing window of the door.

* * * * *